United States Patent [19]

Ravis et al.

[11] 4,081,785

[45] Mar. 28, 1978

[54] DUAL CLASS AMPHIBIOUS TARGET DISCRIMINATOR

[75] Inventors: James C. Ravis, Minnetonka; Curtis P. Hedman, St. Paul, both of Minn.

[73] Assignee: The United States of America as represented by the Secretary of the Air Force, Washington, D.C.

[21] Appl. No.: 442,304

[22] Filed: Feb. 13, 1974

[51] Int. Cl.[2] ..... G08B 21/00; G01S 3/80

[52] U.S. Cl. ..... 340/5 R; 340/16 R; 340/258 R; 340/261; 340/15.5 F

[58] Field of Search ..... 340/16 R, 15, 7 R, 5 R, 340/261, 15.5 F, 258 R; 328/111, 112

[56] References Cited

U.S. PATENT DOCUMENTS

| | | | |
|---|---|---|---|
| 3,564,493 | 2/1971 | Hicklin | 340/16 R |
| 3,573,817 | 4/1971 | Akers | 340/261 |
| 3,585,581 | 6/1971 | Aunne et al. | 340/16 R |
| 3,665,445 | 5/1972 | Riley, Jr. | 340/261 |
| 3,714,620 | 1/1973 | Biren et al. | 340/261 |

*Primary Examiner*—Howard A. Birmiel

*Attorney, Agent, or Firm*—Joseph E. Rusz; George Fine

[57] ABSTRACT

A dual class amphibious target discriminator distinguishes between waterborne carriers and bottom traversing fording vehicles. The distinction is accomplished by examining the seismic signal produced by a candidate target for significant characteristics unique to the specific targets.

2 Claims, 1 Drawing Figure

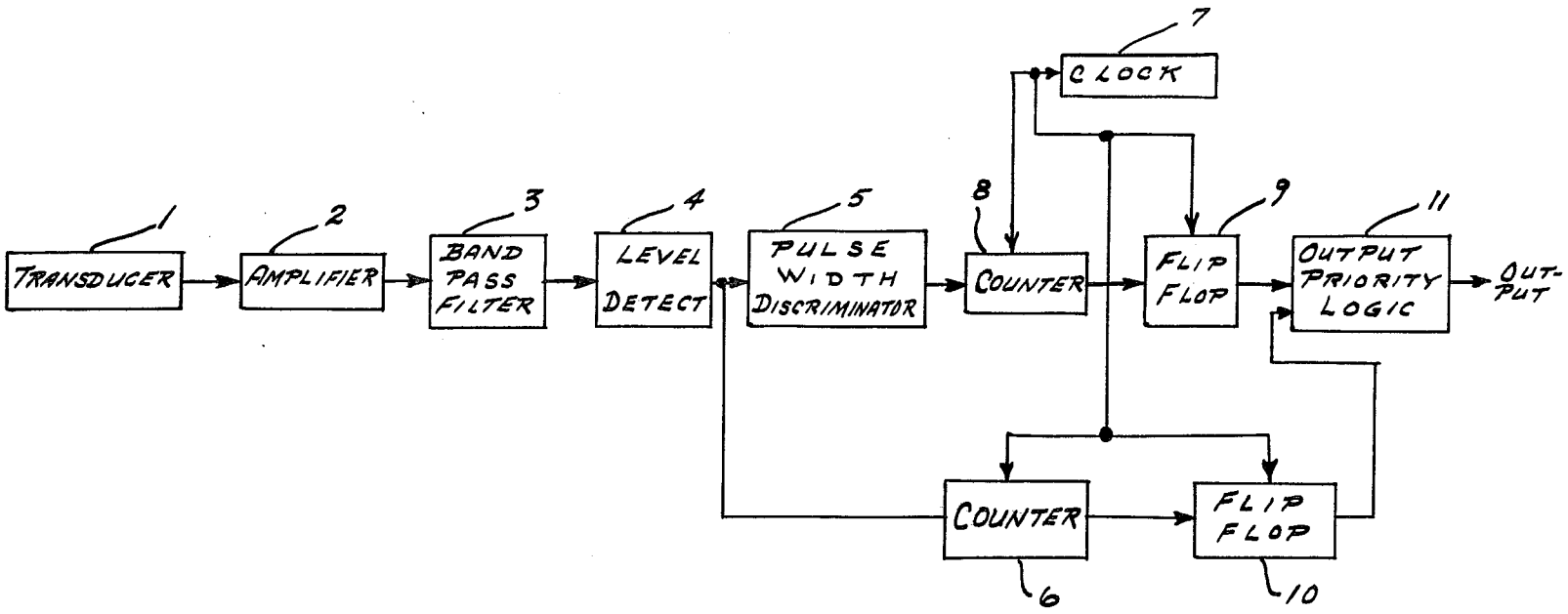
TRANSDUCER
1
AMPLIFIER
2
BAND PASS FILTER
3
LEVEL DETECT
4
PULSE WIDTH DISCRIMINATOR
5
COUNTER
6
CLOCK
7
COUNTER
8
FLIP FLOP
9
FLIP FLOP
10
OUTPUT PRIORITY LOGIC
11
OUT-PUT

DUAL CLASS AMPHIBIOUS TARGET DISCRIMINATOR

BACKGROUND OF THE INVENTION

There exists a requirement for a device to accurately and quickly distinguish at a remote distance a waterborne object from an object moving along the bottom of the water. This information could be used for tactical advantage to determine the threat level of fording vehicles. Also, a device of this nature could be incorporated into a mine, to provide target selectivity, or to enhance kill probabilities against the different targets by modifying event criteria. The present invention provides the aforementioned device.

SUMMARY OF THE INVENTION

A dual class amphibious target discriminator is provided which distinguishes, at a remote location, quickly and accurately between an object traversing the bottom of water from a moving waterborne object. A geophone placed on the bottom of the water being crossed converts the seismic signals from aforesaid objects into their representative signals. The representative signals are detected to provide a series of varying width logic pulses. This pulse train is applied simultaneously to a first counter and to a width discriminator followed by a second counter. The first and second counters count the number of pulses occurring during a predetermined period. Whenever either counter reaches a preset count, an output flip-flop is set. This flip-flop retains the output for a set number of periods, should the respective counter not attain the required count level again. The output channel including the width discriminator is indicative of a waterborne object. The other channel responds to bottom traversing targets.

DESCRIPTION OF THE DRAWINGS

The single FIGURE shows in block diagram form the preferred embodiment of the dual class amphibious target discriminator.

DETAILED DESCRIPTION OF THE PREFERRED EMBODIMENT

Now referring to the single FIGURE, there is shown geophone 1 placed on the body of water being traversed by a waterborne object or an object moving at the bottom. The geophone (velocity sensor) is conventional and responds to seismic signals from the objects and converts the seismic signals into their representative electrical pulses. The geophone acts as a transducer. The waterborne object could be carriers such as M113's, LVTP-7's and LVTP-5 's. The object moving at the bottom of the water could be snorkeling tanks.

The signal from geophone 1 is passed through amplifier 2 and bandpass filter 3 to emphasize the target characteristics. The signal is then applied to a very low conventional threshold (nearly zero) level detector 4. The output of level detector 4 is a series of varying width logic pulses. This pulse train is applied simultaneously to conventional pulse width discriminator 5, which rejects those pulses exceeding a predetermined set width, and to sampling counter 6. Sampling counter 6 counts the number of pulses occurring during a sample interval determined by conventional asynchronous clock 7. The edited pulse train from pulse width discriminator 5 is similarly applied to sampling counter 8, the sampling period of which is controlled by the same clock signal. Flip-flops 9 and 10 are associated with sampling counters 8 and 6, respectively, and both flip-flops receive the same signal from clock 7.

Whenever either sampling counter reaches a preset count, an output flip-flop is set. This flip-flop retains the output for a set number of clock periods, should the respective sampling counter not attain the required count level again. The output of the channel including the pulse width discriminator is indicative of a waterborne object (target). The other channel responds to bottom traversing objects (targets). Hence, a prioritizing logic circuit is used to provide final class separation. This is accomplished by output priority logic 11 which is of conventional logic design. The output of the two flip-flops is input to the priority logic which provides a bottom traversing indication when only the bottom traversing flip-flop is set, and a waterborne indication whenever the waterborne flip-flop is set, regardless of the state of the bottom traversing flip-flop. Of course no indication is given when neither flip-flop is set.

It is noted that the target discriminator of the present invention will provide at the output of flip-flop 9 a signal indicative of a waterborne object and from flip-flop 6 a signal indicative of a bottom traversing object. The priority logic permits a more sophisticated output signal, however it is not a necessity. Other conventional means in place or priority logic 11 may be substituted.

It is emphasized that the discriminator of this invention provides a means of remotely determining the threat level of fording vehicles. This information could be used to tactical advantage. Also, the discriminator could be incorporated into a mine to provide target selectivity, or to enhance kill probabilities against different targets by modifying event criteria.

What is claimed is:

1. A dual class amphibious target discriminator distinguishing between two target groups, one being waterborne objects and the other bottom traversing objects comprising a seismic transducer placed on the bottom of the water being crossed, said seismic transducer converting seismic signals into representative pulse signals characteristic of the objects, means to amplify the representative signals, means to filter the amplified signals at a predtermined bandwidth, the amplification and filtering emphasizing the signal characteristics of the objects, means to detect at a predetermined threshold the characteristic signals from said filter means to provide an output of a series of varying width logic pulses, pulse width discriminator means rejecting pulses exceeding a set width, a clock, a first sampling counter, said first sampling counter and said pulse width discriminator receiving simultaneously the series of varying width logic pulses, said first sampling counter counting the number of pulses occurring during a predetermined sample interval determined by said clock, a second sampling counter receiving pulses from said pulse width discriminator, the predetermined sampling period thereof being also controlled by said clock, and first and second flip-flops also being timed by said clock, said first and second flip-flops receiving the output pulses from said first and second sampling counters, respectively, with either counter reaching a preset count, an output flip-flop is set, this set flip-flop retaining the output for a set number of clock periods, the output of said second flip-flop counter being indicative of a waterborne object and the output of said first flip-flop being indicative of bottom traversing objects.

2. A dual class amphibious target discriminator as defined in claim 1 further including a logic circuit simultaneously receiving the output signals from said first and second flip-flops and providing a bottom traversing object indication whenever only said first flip-flop is set and a waterborne object indication whenever said second flip-flop is set regardless of the state of said first flip-flop.

* * * * *